US005133639A

United States Patent [19]

Gay et al.

[11] Patent Number: 5,133,639

[45] Date of Patent: Jul. 28, 1992

[54] BEARING ARRANGEMENT FOR CENTRIFUGAL PUMP

[75] Inventors: Farral D. Gay, Elkhorn; Steven D. Schneider, Delavan, both of Wis.

[73] Assignee: Sta-Rite Industries, Inc., Milwaukee, Wis.

[21] Appl. No.: 671,957

[22] Filed: Mar. 19, 1991

[51] Int. Cl.[5] ..... F04D 29/02

[52] U.S. Cl. ..... 415/170.1; 415/172.1; 415/199.1; 277/96; 277/96.2

[58] Field of Search ..... 415/170.1, 172.1, 229, 415/230, 199.1, 199.2, 199.3; 277/95, 96, 96.2

[56] References Cited

U.S. PATENT DOCUMENTS

| | | | |
|---|---|---|---|
| 2,034,790 | 3/1936 | Arnutunoff . | |
| 3,037,458 | 6/1962 | Olmstead et al. . | |
| 3,518,021 | 6/1970 | Lake et al. | 415/172 |
| 3,904,211 | 9/1975 | Dega | 277/32 |
| 3,914,072 | 10/1975 | Rowley et al. | 415/174.2 |
| 3,926,443 | 12/1975 | Fenerty et al. | 277/96.2 |
| 4,037,985 | 7/1977 | Karassik et al. | 415/175 |
| 4,063,846 | 12/1977 | Eagle | 415/199.2 |
| 4,099,890 | 7/1978 | Murakami et al. . | |
| 4,152,096 | 5/1979 | Murakami et al. . | |
| 4,172,690 | 10/1979 | Kuntz | 415/199.2 |
| 4,245,952 | 1/1981 | Eberhardt . | |
| 4,281,839 | 8/1981 | Schoenmeyr | 277/93 SD |
| 4,410,188 | 10/1983 | Copes | 277/65 |
| 4,511,307 | 4/1985 | Drake | 415/172 R |
| 4,572,056 | 2/1986 | Funke | 92/86 |
| 4,655,684 | 4/1987 | Haentjens | 415/170 A |
| 4,664,595 | 5/1987 | Tsuji et al. | 415/170 A |
| 4,746,269 | 5/1988 | Raab | 415/170.1 |
| 4,768,923 | 9/1988 | Baker | 415/170 A |
| 4,776,598 | 10/1988 | Akema | 277/96.2 |
| 4,824,123 | 4/1989 | Chia | 277/84 |
| 4,826,396 | 5/1989 | Blount | 415/104 |
| 4,871,297 | 10/1989 | Boes et al. | 415/170.1 |
| 4,872,808 | 10/1989 | Wilson | 415/170.1 |
| 4,884,945 | 12/1989 | Boutin | 415/174.2 |
| 4,909,705 | 3/1990 | Katsura et al. | 415/170.1 |
| 4,909,707 | 3/1990 | Wauligman et al. | 415/172.1 |
| 4,913,619 | 4/1990 | Haetjens et al. | 415/172.1 |

*Primary Examiner*—John T. Kwon
*Attorney, Agent, or Firm*—Jansson & Shupe, Ltd.

[57] ABSTRACT

The invention is an improvement in a centrifugal pump of the type having two or more pumping stages. Each stage includes a stationary diffuser and a companion rotatable impeller with a wear ring set arranged between the diffuser and impeller of each stage. The improvement includes a bearing ring formed of a hard material, preferably harder than sand. A second bearing ring is formed of a resilient material in thrust-absorbing, sealing contact with the first ring whereby grit or sand may be lodged between the rings without substantially impairing such contact of the rings with one another. In the first embodiment, the bearing rings perform a sealing function as well as absorb axial thrust. In the second embodiment, a primary sealing function is provided by a separate annular disc with which the impeller is in contact.

7 Claims, 3 Drawing Sheets

BEARING ARRANGEMENT FOR CENTRIFUGAL PUMP

FIELD OF THE INVENTION

This invention relates generally to centrifugal pumps and, more particularly, to such pumps having ring-type bearings.

BACKGROUND OF THE INVENTION

Centrifugal pumps are used for a wide variety of liquid pumping applications. Such pumps share a common design feature in that all use a rapidly-rotating impeller (or several impellers) to impel or "throw" the pumped liquid by centrifugal force, thereby causing such liquid to flow in a direction from the pump inlet toward the pump outlet. Certain of such pumps are used in what may be described as non-recirculating applications. That is, the pumped liquid is drawn from a reservoir or other source, delivered to a point of usage and does not return to the source. Submersible oil well pumps are used in such applications and examples of such pumps are shown in U.S. Pat. No. 4,511,307 (Drake) and U.S. Pat. No. 4,872,808 (Wilson). An example of a centrifugal pump used in a recirculating application (automotive cooling system) is shown in U.S. Pat. No. 3,904,211 (Dega).

Centrifugal pumps may be constructed in plural or single stage configurations. The centrifugal pumps shown in the Drake and Wilson patents are of the plural stage type. Each stage includes a stationary diffuser and a mating, rotating impeller driven by a pump shaft connected to a drive motor. The stages are arranged in "series" to provide an enhanced overall pressure capability.

The pumps shown in U.S. Pat. No. 4,746,269 (Raab) and U.S. Pat. No. 4,884,945 (Boutin et al.) as well as that shown in the Dega patent are of the single stage type. That is, they have a single rotating impeller and, perhaps, a single diffuser or diffuser-like member.

Pumps of the plural stage type, like those shown in the Drake and Wilson patents, use wear ring or bushing arrangements to absorb thrust, help prevent wear and/or provide a seal-like construction between a diffuser and its mating impeller. The pump shown in the Drake patent, said to be useful with sand-laden fluids, shows a thrust member (attached to an impeller) and a second annular member (attached to a diffuser) to form a bearing. Such bearing carries both thrust and radial loads. These members are in contact with one another when the pump is operating and both members are made of a material harder than sand. Aluminum oxide is said to be one such material.

Apparently because of the grinding action of the members, sand carried into the bearing is broken down to a size such that the grains can pass between the bearing surfaces. The second annular member has a recess and shoulder which define, at their intersection, what may be termed a groove or notch.

The pump shown in the Wilson patent uses what are called down-thrust bushings and up-thrust bushings of an unspecified material. Each such bushing is an annular ring spaced from all others. That is, the bushings are not in contact with one another. Thrust is absorbed by a single central bearing arrangement after the down-thrust bushings have "worn-in."

The aforementioned arrangements shown in the Drake and Wilson patents differ in at least one respect from those shown in the Dega, Raab and Boutin et al. patents. Those shown in the Drake and Wilson patents are "wet" on both sides of the bushings or members and permit fluid to intermittently pass between them, at least during certain moments of pump operation. On the other hand, those shown in the Dega, Raab and Boutin et al. patents are provided to separate a "wet" area from a "dry" area by preventing fluid migration past the seal.

In the Dega arrangement, the stationary seal is ceramic while the rotating seal is made of carbon or plastic to permit "lapping" of the rotating seal. This is said to provide a positive high pressure seal. The arrangement shown in the Raab patent is similar in that the stationary ring is ceramic and the rotating ring is carbon. The arrangement has a rotary part made of a resilient material to urge the carbon ring into engagement with the ceramic ring.

Some of the foregoing arrangements exhibit certain disadvantages. The arrangement of the Drake pump, with its hard thrust and annular members, requires (or is understood to require) that sand "dwell" within the pump—and particularly adjacent the members—until it is ground to particles of a sufficiently small size to pass between the bearing surfaces. The Drake patent describes that fluid and sand will "recirculate" in the pump, presumably until such sand can be ground to small particles. There is no suggestion as to what effect an overabundance of sand might have on pump operation. And the seal members are spaced well outward radially from the pump centerline, thereby diminishing the pump's efficiency somewhat.

Because both members are hard, even the passage of small grains of sand appears to require that the members separate as such grains pass between them. Such separation, even though slight and perhaps momentary, tends to "break" the seal between the members and diminish the volumetric efficiency of the pump. If sand grains perchance lodge between such members for a prolonged time, such diminished efficiency may be more serious.

And the groove or notch defined by the recess and the shoulder of the second annular member seems to be a likely place where grains of sand could become trapped. The impression conveyed by the Drake patent is that sand can pass through the pump in only one way, i.e., by first grinding it to fine particles. And there is seemingly no way to accommodate grains which lodge between the members and still retain volumetric efficiency.

The Wilson patent, which deals with a modular bearing not directly related to diffuser/impeller sealing, describes that abrasives are removed from such bearing by evacuation holes. Apparently the matter of bushing wear is solved by avoiding bushing-to-bushing contact and by permitting the bushings to wear in slightly before thrust load is taken up by the modular bearing.

OBJECTS OF THE INVENTION

It is an object of the invention to provide an improved bearing arrangement for a centrifugal pump which overcomes some of the problems and disadvantages of the prior art.

Another object of the invention is to provide an improved bearing arrangement wherein the fluid sealing function and the thrust-absorbing function are performed by separate means.

Another object of the invention is to provide an improved bearing arrangement whereby the efficiency of the pump is improved.

Yet another object of the invention is to provide an improved bearing arrangement whereby grit may be lodged between pairs of rings without substantially impairing sealing contact of such rings.

Yet another object of the invention is to provide an improved bearing arrangement which reduces the tendency of grit to become trapped between the contacting surfaces of the rings.

How these and other objects are accomplished will become more apparent from the following detailed description taken in conjunction with the drawing.

SUMMARY OF THE INVENTION

The invention is an improvement in a centrifugal pump of the type having a generally cylindrical housing, a concentric drive shaft and at least one pumping stage within the housing. In many such centrifugal pumps, there are plural or "stacked" pumping stages. Each stage includes a stationary diffuser formed as a part of or attached to the housing. Each stage also includes a companion impeller coupled to the shaft to be driven thereby and rotatable with respect to the adjacent diffuser. Each stage also includes a bearing set for absorbing axial thrust as results from pumping fluid.

The improvement comprises a first bearing ring formed of a hard material and a second bearing ring formed of a resilient material in thrust-absorbing contact with the first ring. Grit may be lodged between such rings without substantially impairing the thrust-absorbing contact. In one version, the second ring is of laminated construction while in another version, the second ring is of substantially homogeneous construction and made of a rubber-like material.

In centrifugal pumps of the foregoing type, grit is often present in the pumped medium. Therefore, it is preferable that the bearing set be constructed to avoid a tendency to trap grit between the rings. To that end, each bearing preferably has a generally planar sealing surface. The resulting absence of crevices thereby reduces the tendency of grit to become trapped between such surfaces.

In one preferred embodiment, such bearing set serves two purposes. It not only absorbs axial thrust resulting from pump operation but it also constitutes the sealing means between the diffuser and impeller as needed to give the pump its pressure capability. In another preferred embodiment, the bearing set performs only one primary function, namely, thrust absorption. Sealing between the diffuser and the impeller is by a separate flat annular disc forming a part of the diffuser and with which the impeller is in running, sealing contact. Further details of the invention are set forth below.

DETAILED DESCRIPTION OF PREFERRED EMBODIMENTS

Figure 1:
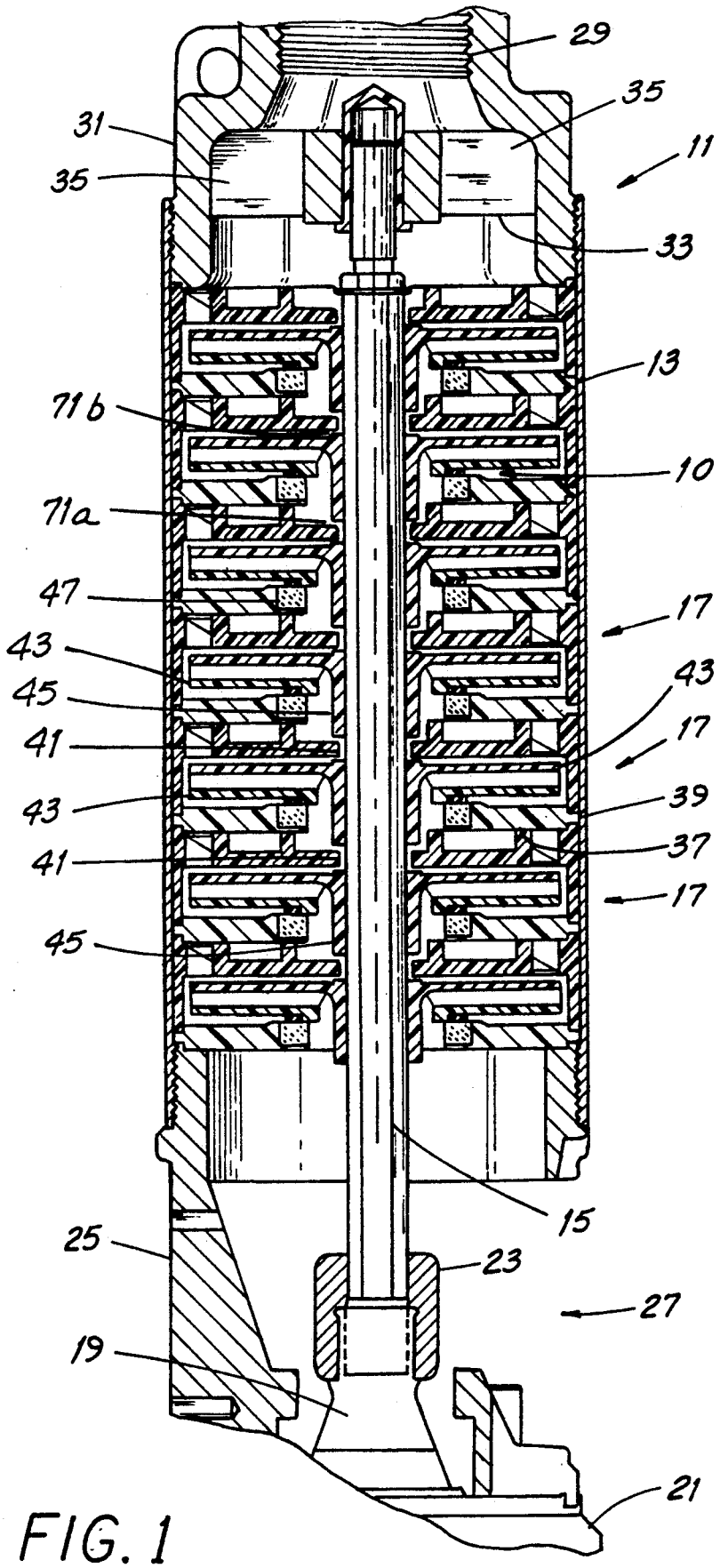
FIG. 1 is a cross-sectional side elevation view of a centrifugal pump having a first embodiment of the invention. Such view is in a plane coincident with the longitudinal pump centerline and the pump shaft is shown in full representation.

Before describing the improved bearing arrangement 10, the general configuration of a centrifugal pump 11 will be explained. Referring to FIG. 1, the pump 11 is of the fixed diffuser, floating impeller type. Such pump 11 includes an outer, generally cylindrical housing 13 containing a drive shaft 15 and a plurality of pumping stages 17, seven in the illustrated embodiment. The lower end of the shaft 15 is coupled to the rotatable shaft 19 of an electric drive motor 21 by a sleeve 23 while the lower end of the housing 13 is coupled to the motor 21 by an adapter 25. The adapter 25 includes an inlet port 27 through which liquid, e.g., water enters the pump 11 and is delivered to the output port 29 as described below.

As the liquid is delivered to such port 29, a reactive thrust is developed downward (as viewed in FIG. 1) and generally parallel to shaft 15. It is this reactive thrust that is absorbed by rings 47, 51 or **47*a*, 81** as described below.

The upper end of the housing 13 is coupled to an output flange 31 having mounted therewithin a bearing collar 33 for supporting the upper end of the shaft 15. Openings 35 in the collar 33 permit liquid to flow to the outlet port 29 to be expelled to a delivery pipe (not shown).

Figure 2A:
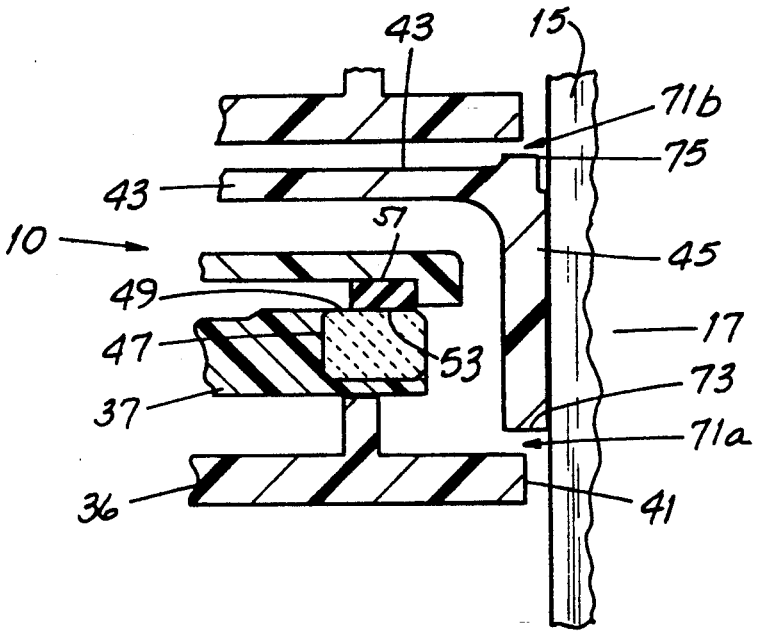
FIG. 2A is a greatly enlarged view of a portion of FIG. 1 showing one version of a first embodiment of the improved bearing arrangement.
Figure 2B:
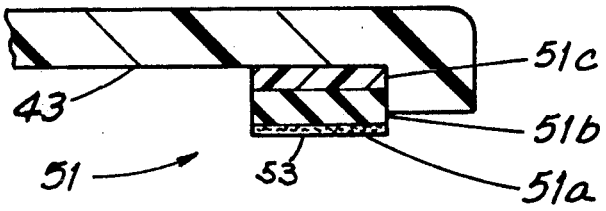
FIG. 2B is a greatly enlarged view of a portion of FIG. 1 showing another version of the first embodiment of the improved bearing arrangement shown in FIG. 1.

Referring additionally to FIGS. 2A and 2B, each pumping stage 17 (except that nearest the motor) includes an annular intake plate 36 and all such stages 17 include an annular diffuser 37, the latter having an outer edge adjacent the housing 13 or in contact therewith. The inner rim of each plate 36 is spaced slightly from the shaft 15 to avoid contact therewith. Immediately upward of each diffuser 37 is a rotatable impeller 43 coupled to the drive shaft 15 by a collar 45. The shape of the opening through the collar 45 conforms generally to the cross-sectional shape of the drive shaft 15 which in one highly preferred embodiment is hexagonal. Of course, other cross-sectional shapes may be used to provide driving engagement between the shaft 15 and the collar 45. The size of the opening in the collar 45 and the cross-sectional dimensions of the shaft 15 are cooperatively selected to provide a readily-sliding fit therebetween.

Each diffuser 37 includes a first bearing ring 47 molded or otherwise securely attached thereto. Each such ring 47 is annular and has an upward-facing generally planar sealing surface 49. In a highly preferred version, such bearing ring 47 has a generally square cross-sectional shape and is made of ceramic or other material having a hardness greater than that of sand.

Each impeller 43 includes a resilient second bearing ring 51 affixed thereto by bonding or other means of attachment. Each such ring 51 is annular, has a generally planar, downward-facing sealing surface 53 and is generally square in cross-sectional shape.

In the arrangement shown in FIG. 2B, each second bearing ring 51 has a lower, relatively thin layer **51*a* of reinforced linen, a thicker middle layer 51*b* of Buna N and an upper layer 51*c* of reinforced phenolic. In the arrangement shown in FIG. 2A, each second ring 51 is of substantially homogeneous construction and made of natural or synthetic rubber or another rubber-like resilient material such as Buna N, for example. Other resilient materials (including those useful in layer 51***a*) having lubricity in water are likewise suitable.

It will be noted that a slight vertical clearance 71*a* is provided between the lower rim 73 of the collar 45 and the inner rim 41 of the adjacent diffuser 37 immediately below. Such clearance 71*a* helps assure that during normal operation, each impeller 43 may "settle" so that its bearing ring 51 is in contact with the bearing ring 47 on such diffuser 37. Such contact is preferred for thrust absorption and for pressure sealing between stages 17 to maintain volumetric efficiency.

A similar vertical clearance 71*b* is also provided between the upper rim 75 of the collar 45 and the adjacent diffuser 37 immediately above. Such clearance 71*b* permits each impeller 43 to "jump" or move upward slightly at the instant of startup and because of the pressure imbalance across it. Such momentary upward impeller movement is a known phenomenon.

Figure 3:
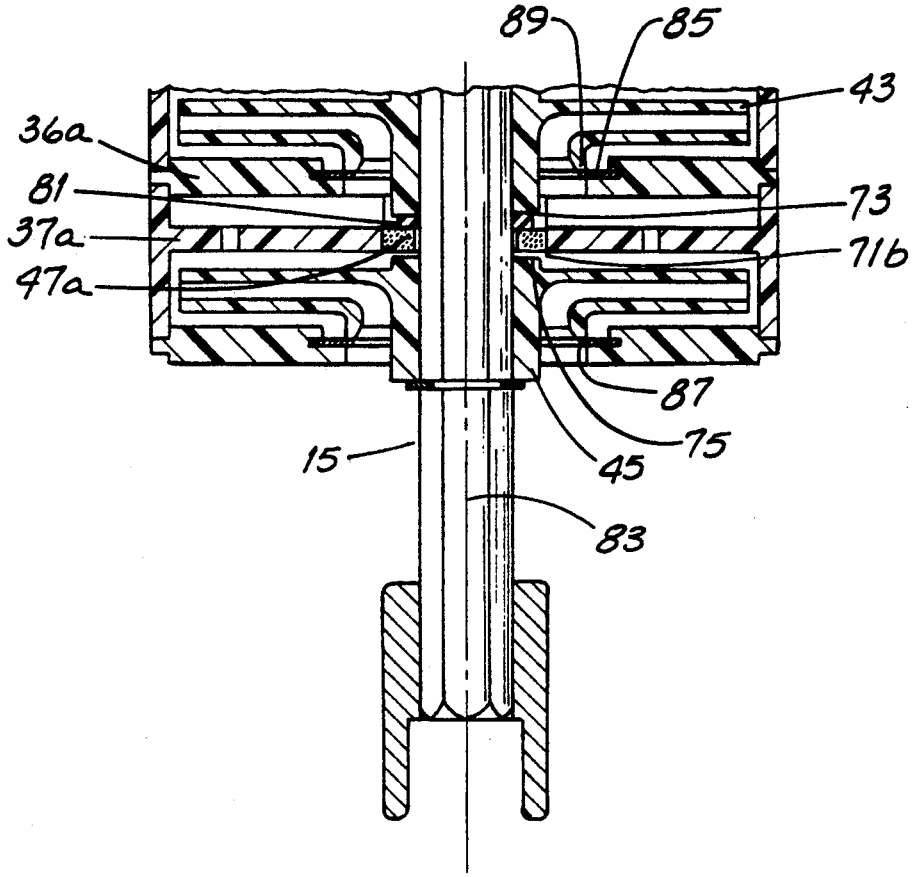
FIG. 3 is a cross-sectional side elevation view with parts broken away of a centrifugal pump similar to that of FIG. 1 but showing a second embodiment of the invention. Such view is in a plane coincident with the longitudinal pump centerline and the pump shaft is shown in full representation.

In another embodiment shown in FIG. 3, the first bearing ring 47*a* is mounted at the inner perimeter of the diffuser 37*a* in a way to provide slight running clearance between the ring 47*a*, which is stationary, and the shaft 15 which rotates. The second bearing ring 81 is mounted on the lower rim 73 of the collar 45 to be in contact with ring 47*a* and with the shaft 15. The shaft 15 has a longitudinal axis 83. The ring 81 may contact the shaft 15 since both rotate simultaneously and at the same speed. When so arranged, the rings 47*a*, 81 absorb axial thrust resulting from pump operation in delivering liquid to the outlet port 29. Such rings 47*a*, 81 also perform a sealing function but are primarily used as thrust absorbers.

In the arrangement shown in FIG. 3, the bearing ring 47*a* may be constructed like ring 47, i.e., of ceramic or other material harder than sand. Similarly, the bearing ring 81 is preferably laminated like ring 51 shown in FIG. 2B. Or it may be homogeneous like ring 51 shown in FIG. 2A except that pump performance may suffer appreciably.

A flat, smooth, annular disc 85 is mounted on the intake plate 36*a* and has its inner rim 87 in registry with an edge 89 of the impeller 43. In a preferred arrangement, the disc 85 is stainless steel and provides a surface upon which edge 89 may seal during pump operation. When so arranged, the disc 85 and edge 89 prevent liquid from leaking past the plate 36*a* and impeller 43 and substantially impairing the volumetric efficiency of the pump 11.

It is to be appreciated that like the rings 47, 51 of the first embodiment, the rings 47*a*, 81 give the pump 11 its "sand-handling" ability. And when sand comes between the rings 47*a*, 81, there is some tendency for the edge 89 to contact disc 85 somewhat more lightly or to separate very slightly from disc 85. This helps the plastic edge 89 from being prematurely impaired or destroyed by the grinding action of sand.

It is to be noted that in FIG. 3, the outside and inside diameters of rings 47*a*, 81 are smaller than the diameters of rings 47, 51, respectively, as shown in FIG. 1. Stated another way, the diameters of rings 47*a*, 81 are only slightly greater than the maximum thickness of the shaft or the diameter of an imaginary circle circumscribing the shaft 15. A parameter called the "pressure-velocity" figure is used by designers of annular thrust bearings as an indication of the amount of frictional loading that results from an annular bearing set of a particular diameter. Such parameter takes into account the pressure on the bearing surfaces (as results from axial thrust loading) and the linear velocity at which one of the surfaces moves with respect to the other.

Bearings having increasingly larger diameters also have increasingly larger pressure-velocity figures even though the axial thrust loading and angular velocity (e.g., rotational speed in revolutions per minute) may be identical. This is so since at larger diameters, the linear velocities become larger. All other factors being equal, the arrangement shown in FIG. 3 has a more favorable pressure-velocity figure than that of FIG. 1 since its rings 47*a*, 81 are of smaller diameter. The result is that in the embodiment of FIG. 3, there is less wasted horsepower expended in overcoming bearing ring friction.

In operation, it is assumed that the pump 11 and motor 21 are installed in a cavity, e.g., a water well wherein the pump 11 is flooded with liquid in which sand or other grit-like fines may be entrained. At the instant of energization of the motor 21 and prior to the time when liquid in the outlet port 29 is pressurized for expulsion, each impeller 43 tends to "jump" or move upward slightly because of the pressure imbalance across it. The clearance 71*b* permits such momentary impeller movement, a known phenomenon.

Because of such impeller movement, the bearing rings 47 and 51 (or 47*a* and 81) separate slightly and momentarily from one another. Such momentary separation permits any particles of sand and grit which are not firmly embedded in the second bearing ring 51 or 81 to be washed from between the surfaces 49, 53. Of course, the planar surfaces 49, 53 facilite such washing in that they are devoid of any crevices where such particles might be retained.

Even if such particles become embedded in the second bearing ring 51 (or 81), the resilient nature of such ring 51 (81) permits such particles to "hide" between the rings 47, 51 (47*a*, 81) while yet permitting such rings to maintain contact. Therefore, the thrust-absorbing and sealing capabilities of the rings 47, 51 (47*a*, 81) is generally maintained.

The rings 47, 51, 47*a*, 81 and disc 85 are described herein as having diameters or are otherwise referred to in ways suggesting such parts have a circular dimension. It is to be appreciated that polygonal shapes could be used without departing from the invention and shapes other than round are included in such descriptions and references.

While the principles of this invention have been described in connection with specific embodiments, it should be understood clearly that these descriptions are made only by way of example and are not intended to limit the scope of the invention.

We claim:

1. In a centrifugal pump of the type having a shaft and plural stages, each stage including a stationary diffuser and a companion rotatable impeller with a bearing ring set disposed between the diffuser and impeller, the improvement comprising:

a first bearing ring formed of a hard material;

a second bearing ring formed of a resilient material in thrust-absorbing contact with such first ring in the presence of grit between such rings;

one ring being movable to momentarily separate from the other ring at pump startup;

whereby during pumping, grit may be lodged between such rings without substantially impairing ring contact and grit washes from between rings at pump startup.

2. The pump of claim 1 including a collar rim adjacent to the shaft and wherein the rings have a diameter generally corresponding to that of the rim, thereby reducing the input horsepower required to operate such pump.

3. The pump of claim 2 further including an annular disc mounted on the diffuser for sealing with the impeller thereby improving the volumetric efficiency of such pump.

4. The pump of claim 1 wherein such second ring is laminated.

5. The pump of claim 4 wherein such second ring includes at least one phenolic-bearing layer and a layer which includes a fabric.

6. The pump of claim 1 wherein each ring has a generally planar sealing surface thereby reducing the tendency of grit to become trapped between such surfaces.

7. The pump of claim 1 wherein the first ring is attached to a diffuser.

* * * * *